US010546456B2

(12) United States Patent
Peltz et al.

(10) Patent No.: US 10,546,456 B2
(45) **Date of Patent: *Jan. 28, 2020**

(54) GAMING MACHINE HAVING A DUAL CHUTE

(71) Applicant: Bally Gaming, Inc., Las Vegas, NV (US)

(72) Inventors: Martin Anthony Peltz, Las Vegas, NV (US); Philip Laroach, Henderson, NV (US); Charles R. Miller, Sr., Las Vegas, NV (US); Gordon Myers, Reno, NV (US); Kurt Spencer, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/011,729

(22) Filed: Jun. 19, 2018

(65) Prior Publication Data

US 2018/0308310 A1 Oct. 25, 2018

Related U.S. Application Data

(63) Continuation of application No. 15/485,467, filed on Apr. 12, 2017, now Pat. No. 10,089,821, which is a continuation of application No. 14/863,049, filed on Sep. 23, 2015, now Pat. No. 9,711,002, which is a continuation of application No. 12/717,126, filed on Mar. 3, 2010, now abandoned.

(51) Int. Cl.

| | |
|---|---|
| ***A63F 9/00*** | (2006.01) |
| ***G07F 17/32*** | (2006.01) |
| ***G07D 11/14*** | (2019.01) |
| ***G07F 11/00*** | (2006.01) |
| ***G07F 17/42*** | (2006.01) |

(52) U.S. Cl.

CPC ..... *G07F 17/3216* (2013.01); *G07D 11/14* (2019.01); *G07F 11/00* (2013.01); *G07F 17/32* (2013.01); *G07F 17/3246* (2013.01); *G07F 17/3251* (2013.01); *G07F 17/42* (2013.01)

(58) Field of Classification Search

None

See application file for complete search history.

(56) References Cited

U.S. PATENT DOCUMENTS

| | | | |
|---|---|---|---|
| 7,494,414 | B2 | 2/2009 | Hedrick et al. |
| 2004/0053698 | A1 | 3/2004 | Tastad et al. |
| 2004/0092316 | A1 | 5/2004 | Nagano |
| 2004/0142752 | A1 | 7/2004 | Gauselmann |
| 2005/0282627 | A1 | 12/2005 | Hedrick et al. |
| 2008/0153580 | A1 | 6/2008 | Beadell et al. |
| 2008/0153581 | A1 | 6/2008 | Hedrick et al. |
| 2009/0111562 | A1 | 4/2009 | Chudd et al. |
| 2009/0221375 | A1 | 9/2009 | Luciano, Jr. et al. |

*Primary Examiner* — Seng Heng Lim

(74) *Attorney, Agent, or Firm* — Marvin A. Hein

(57) ABSTRACT

The present invention provides a gaming machine including a cabinet housing which houses a receiver and a dispenser. An opening extends through the housing. A receiver chute extends between the opening and the receiver, with the receiver chute having a first receiver portion. Similarly, a dispenser chute extends between the opening and the dispenser, with the dispenser chute having a first dispenser portion. The first receiver portion and the first dispenser portion are coextensive, such that the cabinet housing both receives and dispenses currency and currency-type media at the opening.

17 Claims, 3 Drawing Sheets

GAMING MACHINE HAVING A DUAL CHUTE

CROSS-REFERENCE TO RELATED APPLICATIONS

This application is a continuation of U.S. patent application Ser. No. 15/485,467, filed Apr. 12, 2017, which is a continuation of Ser. No. 14/863,049 filed Sep. 23, 2015 (now U.S. Pat. No. 9,711,002, issued Jul. 18, 2017), which is a continuation of U.S. patent application Ser. No. 12/717,126 filed Mar. 3, 2010, each of which is herein incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

This invention relates to gaming machine cabinets and, more particularly, to an upright gaming machine cabinet having a dual chute for both receiving and dispensing currency and/or various currency representative media.

Traditional gaming machines include one opening for receiving currency or other credit-adding media, and another, separate opening for dispensing winnings in some form. This is often confusing for a player, who may incorrectly attempt to insert currency into the dispensing opening in the machine, and/or conversely trying to locate his winnings from the receiving opening of the machine, which will be empty. A gaming machine cabinet having one opening for both receiving and dispensing currency or the like would be a stark improvement in the field of gaming.

SUMMARY

Briefly, and in general terms, the present invention provides a gaming machine including a cabinet housing having an opening extending through at least one side thereof, with both a receiving chute and a dispensing chute extending away from the opening. That is, one opening is configured to both receive and dispense currency and other currency- or credit-indicating media. In one embodiment, a receiving chute extends between the opening and a receiver, while a dispensing chute extends between the opening and a dispenser. A bezel may extend through the opening. The receiving chute may be defined by a receiving mechanism, with the dispensing chute being defined by a dispensing mechanism. In this embodiment, the receiving mechanism and the dispensing mechanism may be the same.

The present invention also provides a gaming machine including a cabinet housing which houses a receiver and a dispenser. An opening extends through the housing. A receiver chute extends between the opening and the receiver, with the receiver chute having a first receiver portion. Similarly, a dispenser chute extends between the opening and the dispenser, with the dispenser chute having a first dispenser portion. The first receiver portion and the first dispenser portion are coextensive, such that the cabinet housing both receives and dispenses currency and currency-type media at the opening.

Other features and advantages will become apparent from the following detailed description, taken in conjunction with the accompanying drawings, which illustrate by way of example, the features of the various embodiments.

DETAILED DESCRIPTION

Figure 1:
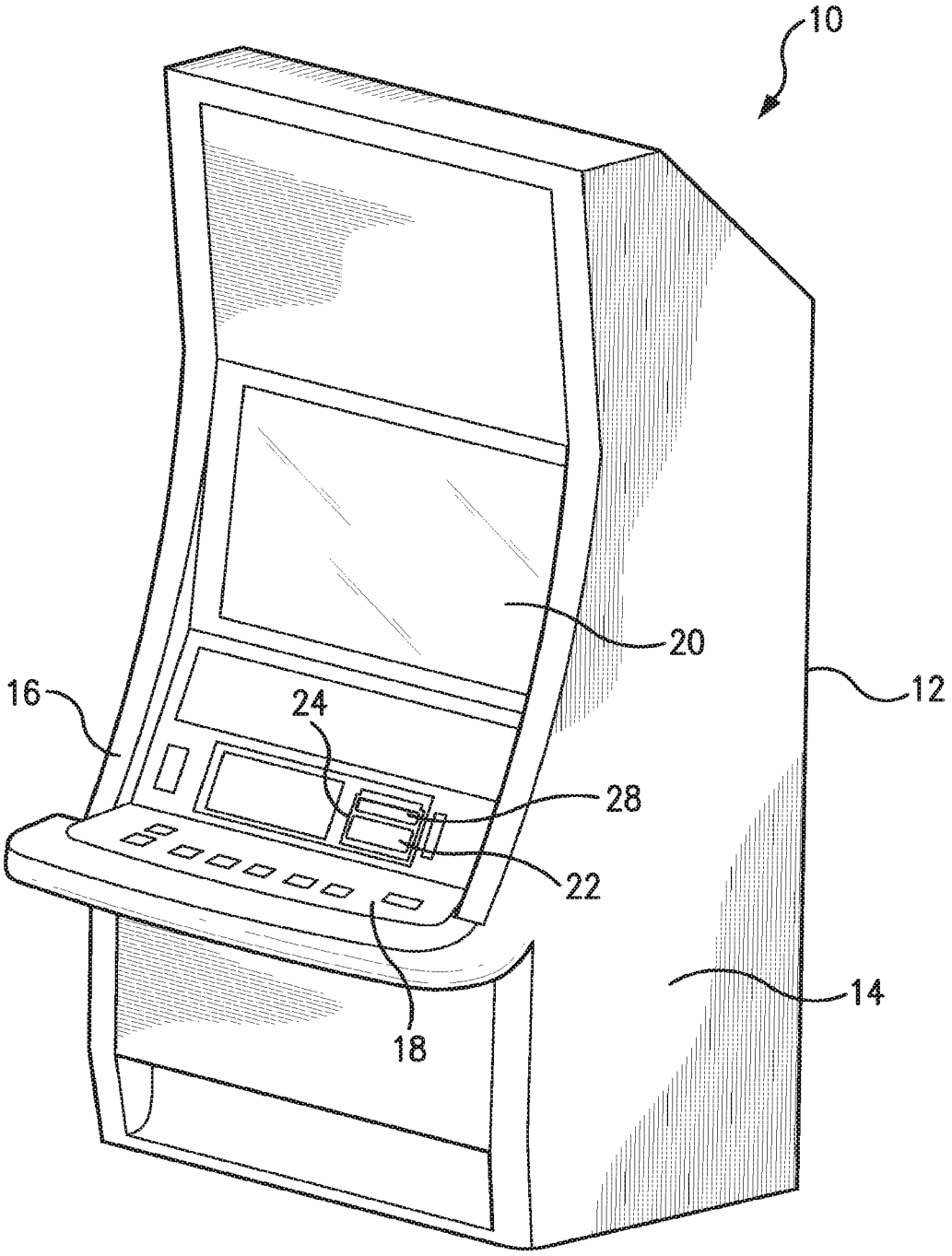
FIG. 1 presents a perspective view of an upright gaming machine in accordance with the present invention.

Referring now to the drawings, wherein like reference numerals denote like or corresponding parts throughout the drawings, and more particularly to FIG. 1, an upright gaming machine for play by at least one player (not shown) is generally shown at 10 in accordance with the present invention. In the preferred embodiment, the gaming machine 10 may present a video slot machine, a video keno game, a lottery game, a bingo game, a Class II bingo game, a roulette game, a craps game, a blackjack game, a video representation of a wheel or, or some other game of chance. The game could also involve a varying degree of player skill.

The gaming machine 10 includes a cabinet housing 12 preferably defined as the interior of a first side 14, a second side (not shown), a front wall 16 and a rear wall (not shown). The cabinet housing 12 may also include a base and a top, neither of which are explicitly shown in FIG. 1. The gaming machine 10 further includes a player control area 18 and a display 20. Typically, the player control area 18 will be a button deck or button area having one or more buttons to facilitate game play. Player control areas are well known in the art, and are usable to receive input from a player for various purposes including such things as selection of wager denomination, initiation of a game, or cashing out winnings from the gaming machine. The display 20 is used to present information, including presenting a game for play.

In the preferred embodiment, the gaming machine 10 includes a door 22 having a bezel 24 extending therethrough. The door 22 is preferably movable to reach the interior of the cabinet housing 12 for service or other maintenance. It should be noted that the bezel 24 need not extend through the door 22 to practice the present invention. It matters only that there be an opening of some sort, in the preferred embodiment the bezel 24, through the cabinet housing 12.

Figure 2:
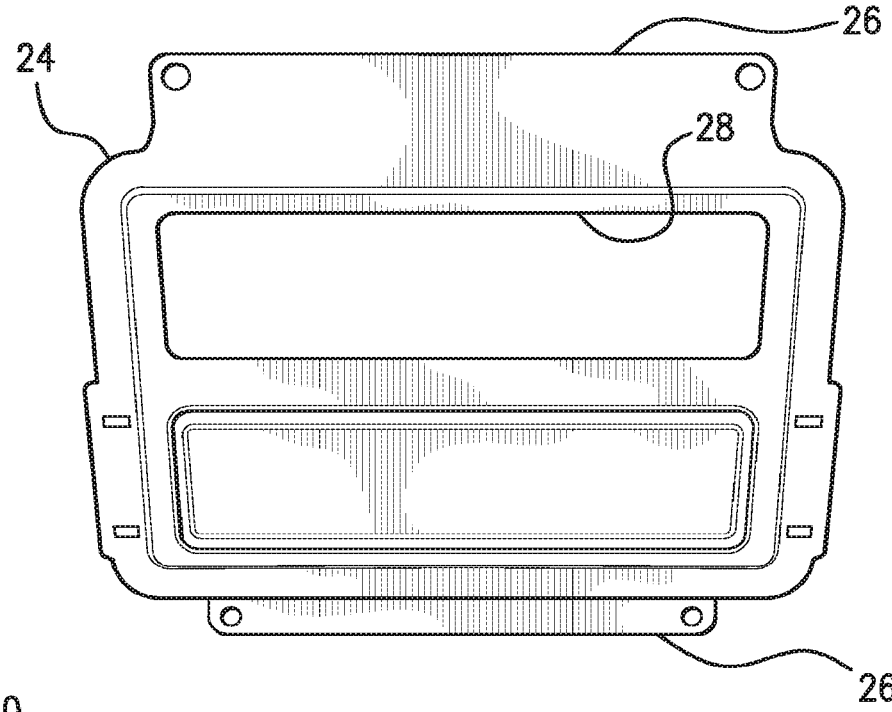
FIG. 2 presents a perspective view of a bezel of the gaming machine of FIG. 1.

Turning to FIG. 2, a perspective view of the bezel 24 is shown. The bezel 24 includes mounting portions 26 for mounting the bezel 24 to the door 20, or to another part of the cabinet housing 12. The bezel 24 defines an opening 28 which extends through the cabinet housing 12.

Figure 3:
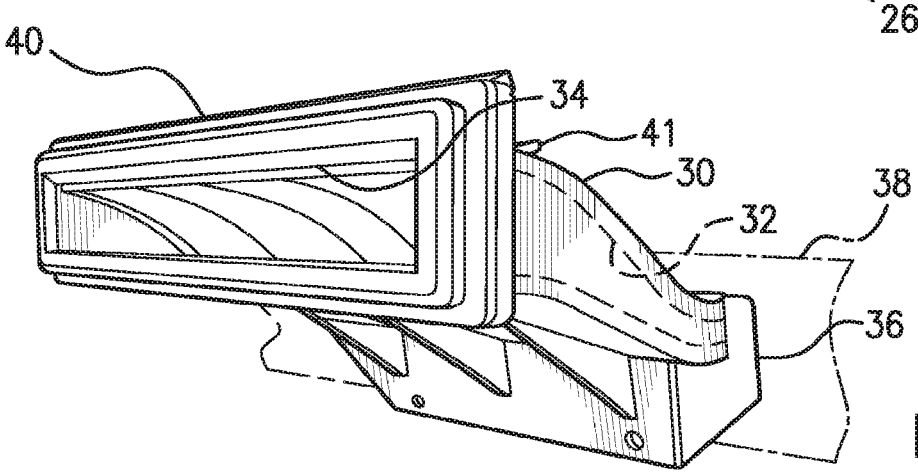
FIG. 3 presents a perspective view of a dispensing mechanism of the gaming machine of FIG. 1.

FIG. 3 shows a receiving mechanism 30 which defines a receiving chute at 32. In the preferred embodiment, the receiving mechanism 30 further defines a receiving slot 34, with the receiving slot 34 nestable within the opening 28 in the bezel 24. A lip 40 on the receiving slot 34 helps align the receiving mechanism 30 within the opening 28 in the preferred embodiment. The receiving mechanism 30 also includes a mounting portion 36 for mounting the receiving mechanism 30 to a receiver 38. In the preferred embodiment, the receiver 38 is a currency acceptor, which may receive currency or any other currency- or credit-indicating media such as a ticket or a smart card as known in the art. In the preferred embodiment, the receiving mechanism 30 also includes a routing portion 41, the purpose of which will be discussed in conjunction with FIG. 5.

Figure 4:
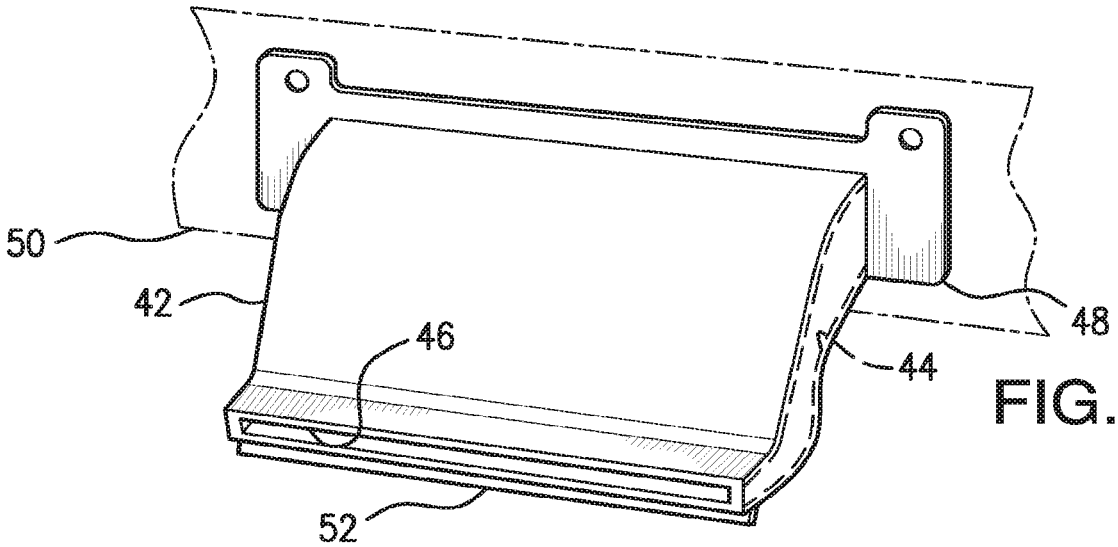
FIG. 4 presents a perspective view of a receiving mechanism of the gaming machine of FIG. 1.

FIG. 4 shows a perspective view of a dispensing mechanism 42 which defines a dispensing chute at 44 and a dispensing slot 46 which opens at opening 28 in bezel 24. The dispensing slot 46 is disposed such that items proceed down through the dispensing chute 44 and exit the cabinet housing 12 at opening 28. The dispensing mechanism 42 includes a mounting portion 48 for mounting the dispensing mechanism 42 to a dispenser 50. In the preferred embodiment, the dispenser 50 is a printer. However, the dispenser 50 can be anything designed to dispense winnings to a player within the scope of the present invention. In the preferred embodiment, a lip 52 on the dispensing mechanism 42 helps align the dispensing mechanism 42 within the opening 28.

Figure 5:
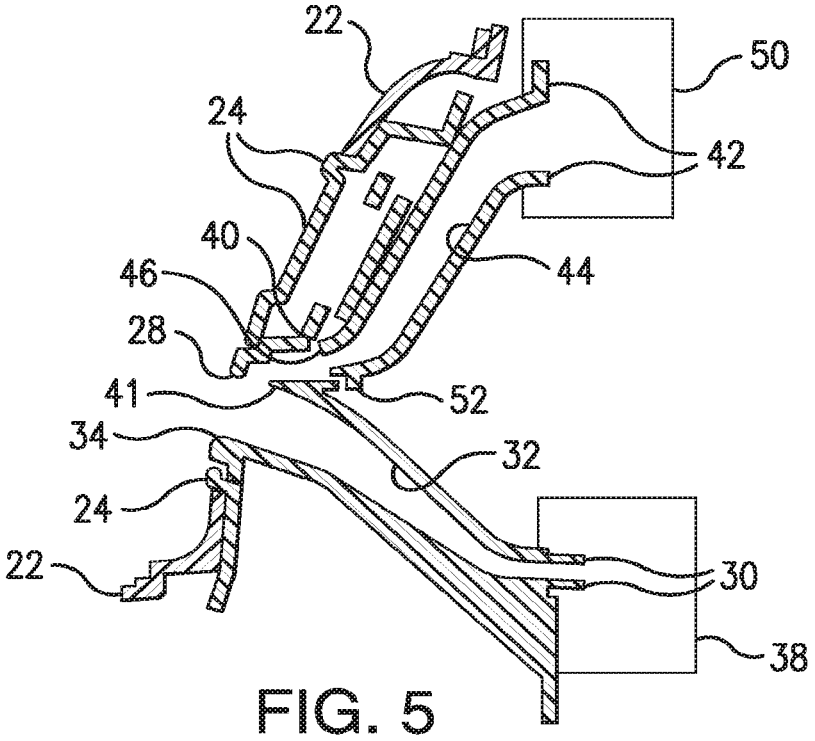
FIG. 5 presents a cross-section of a portion of the gaming machine of FIG. 1.

FIG. 5 shows a cross-section of the bezel 24, the receiving mechanism 30 and the dispensing mechanism 42 nested together within the opening 28, as in the preferred embodiment of the present invention. In operation, a player may input currency or other credit-indicating media through opening 28. The routing portion 41 of the receiving mechanism 30, along with the overall geometry resulting from fitting the parts together, helps ensure the currency remains within the receiving chute 32 and does not inadvertently travel up the dispensing chute 44. While the preferred embodiment utilizes the routing portion 41 and the overall geometry to prevent misrouting, other ways of ensuring proper routing can be used within the scope of the present invention. The currency travels through the receiving chute 32 to the receiver 38. When a player chooses to cash out, a ticket or some other sort of credit-indicating media is generated by the dispenser 50. The ticket travels through the dispensing chute 44, with routing portion 41 of the receiving mechanism 30 again acting to prevent misrouting. The ticket then travels out through opening 28, here through the bezel 24. It should be noted that in the present invention, the bezel 24 has been designed to move with the door 22 to allow access to the interior of the cabinet housing 12 (shown in FIG. 1) without disturbing the assembly described herein. Additionally, the dispensing mechanism 42 has been designed to rotate away from the assembly to provide access to the dispenser 50, which is a printer in the preferred embodiment.

It should be noted that while for aesthetic purposes the preferred embodiment of the present invention contemplates the use of the bezel 24 to define the opening 28, the opening 28 can easily be present in the cabinet housing 12 without the use of the bezel 24. That is, the cabinet housing 12 can define the opening 28 without the use of the bezel 24. Additionally, while the opening 28 in the preferred embodiment is shown through the front wall 16 of the gaming machine 10, the opening 28 could be through and wall of the gaming machine 10 within the scope of the present invention. Additionally, while the preferred embodiment includes a separate receiver 38 and dispenser 50, the present invention can be utilized with a combination receiver/dispenser, such that the receiving chute and the dispensing chute are coextensive. It matters only that at least some portion of a receiving chute and a dispensing chute be coextensive to practice the present invention.

Figure 6:
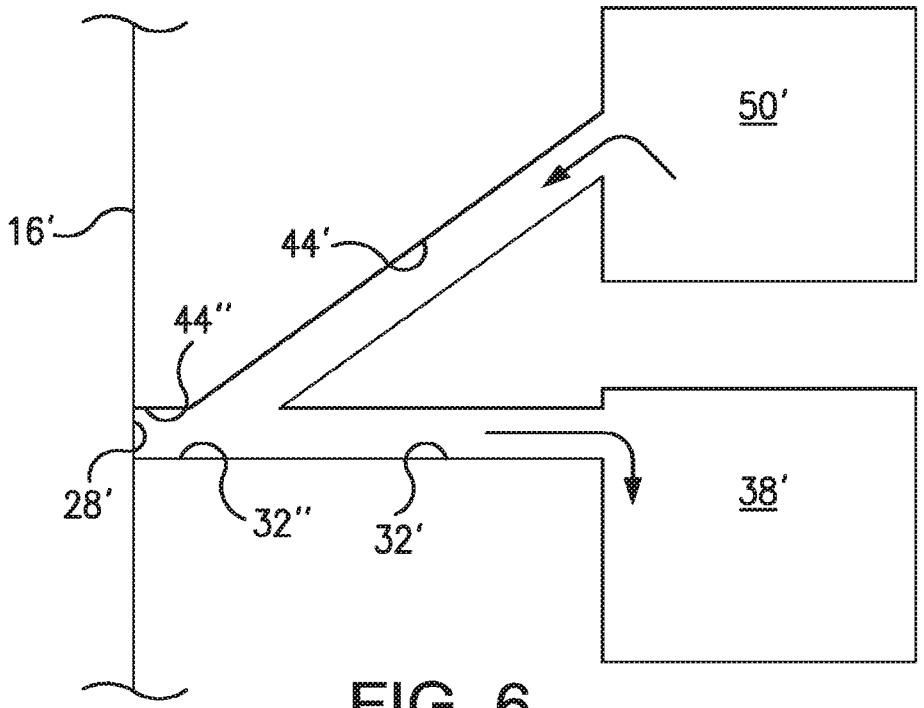
FIG. 6 presents a cross-section of a portion of that shown in FIG. 5.

FIG. 6 further illustrates this point. In FIG. 6, an opening 28' is defined within a gaming cabinet wall 16'. A receiving chute 32' extends between the opening 28' and a receiver 38', while a dispensing chute 44' extends between the opening 28' and a dispenser 50'. The receiving chute 32' includes an opening portion 32", while the dispensing chute 44' also includes an opening portion 44". The opening portions 32" and 44" are coextensive, within the scope of the present invention.

One of ordinary skill in the art will appreciate that not all gaming machines have all these components and may have other components in addition to, or in lieu of, those components mentioned here. Furthermore, while these components are viewed and described separately, various components may be integrated into a single unit in some embodiments.

The preferred embodiment described above is provided by way of illustration only and should not be construed to limit the claimed invention. Those skilled in the art will readily recognize that the claimed invention can be practiced in a substantially equivalent way with various modifications and changes that may be made to the claimed invention without following the example embodiments and applications illustrated and described herein, and without departing from the true spirit and scope of the claimed invention, which is set forth in the following claims.

What is claimed:

1. An assembly comprising:

a currency acceptor configured to accept currency;

a printer configured to print a ticket;

a receiving chute extending between an opening in a cabinet housing and the currency acceptor, the receiving chute configured to convey the currency inserted into the opening to the currency acceptor; and a dispensing chute extending between the opening in the cabinet housing and the printer, the dispensing chute positioned above the receiving chute and configured to convey the ticket printed by the printer to the opening.

2. The assembly of claim 1, wherein at least one of the receiving chute or the dispensing chute defines a sinuous pathway.

3. The assembly of claim 1, further comprising a bezel mounted to the cabinet housing, a portion of the bezel defining the opening.

4. The assembly of claim 3, further comprising receiving and dispensing slots each positioned within the portion of the bezel defining the opening.

5. The assembly of claim 1, wherein the ticket comprises an indication of credit.

6. The assembly of claim 1, wherein the printed ticket is receivable by the receiving chute and acceptable by the currency acceptor.

7. A gaming machine comprising:

a cabinet housing having an opening therein;

a currency acceptor configured to accept currency;

a printer configured to print a ticket;

a receiving chute extending between the opening and the currency acceptor, the receiving chute configured to convey the currency inserted into the opening to the currency acceptor; and a dispensing chute extending between the opening and the printer, the dispensing chute configured to convey the ticket printed by the printer to the opening, wherein at least one of the receiving chute or the dispensing chute defines a sinuous pathway.

8. The gaming machine of claim 7, wherein the dispensing chute is positioned above the receiving chute.

9. The gaming machine of claim 7 further comprising a bezel mounted to the cabinet housing, a portion of the bezel defining the opening.

10. The gaming machine of claim 9, further comprising receiving and dispensing slots each positioned within the portion of the bezel defining the opening.

11. The gaming machine of claim 7, wherein the ticket comprises an indication of credit.

12. The gaming machine of claim 7, wherein the printed ticket is receivable by the receiving chute and acceptable by the currency acceptor.

13. A method of operating an assembly, the assembly including a currency acceptor, a printer, a receiving chute, and a dispensing chute, the receiving chute extending between an opening in a cabinet housing and the currency acceptor, the dispensing chute positioned above the receiving chute and extending between the opening in the cabinet housing and the printer, the method comprising:

conveying, via the receiving chute, currency inserted into the opening to the currency acceptor; and conveying, via the dispensing chute, a ticket printed by the printer to the opening.

14. The method of claim 13, wherein at least one of the receiving chute or the dispensing chute defines a sinuous pathway.

15. The method of claim 13, wherein the assembly further comprises a bezel mounted to the cabinet housing, a portion of the bezel defining the opening.

16. The method of claim 15, wherein the assembly further comprises receiving and dispensing slots each positioned within the portion of the bezel defining the opening.

17. The method of claim 13, further comprising conveying, via the receiving chute, a second printed ticket inserted into the opening to the currency acceptor.

* * * * *